United States Patent [19]

Maier et al.

[11] 4,123,734

[45] Oct. 31, 1978

[54] CIRCUIT BREAKER WITH IMPROVED LATCH MECHANISM

[75] Inventors: Alfred E. Maier, Chippewa; Robert H. Hill, South Beaver Township, Beaver County, both of Pa.

[73] Assignee: Westinghouse Electric Corp., Pittsburgh, Pa.

[21] Appl. No.: 730,107

[22] Filed: Oct. 6, 1976

[51] Int. Cl.[2] ..... H01H 77/06

[52] U.S. Cl. ..... 335/9; 335/22

[58] Field of Search ..... 335/8, 9, 10, 20, 21, 335/22, 172, 174

[56] References Cited

U.S. PATENT DOCUMENTS

| | | | |
|---|---|---|---|
| 2,666,824 | 1/1954 | Dorfman | 335/10 |
| 3,329,912 | 7/1967 | Brackett | 335/8 |
| 3,353,127 | 11/1967 | Frances et al. | 335/9 |

*Primary Examiner*—George Harris

*Attorney, Agent, or Firm*—Robert E. Converse, Jr.

[57] ABSTRACT

A three pole molded case circuit breaker including a push-to-trip button, a flux transfer shunt trip mechanism, an undervoltage trip mechanism, and an improved latch mechanism. The latch mechanism comprises a metal trip bar covered with insulating tubing and adapted for translational movement to actuate the latch mechanism and trip the contacts. Contact carrier movement during the tripping operation serves to reset the latch mechanism.

21 Claims, 6 Drawing Figures

CIRCUIT BREAKER WITH IMPROVED LATCH MECHANISM

BACKGROUND OF THE INVENTION

1. Field of the Invention

The invention relates to electrical apparatus, and more particularly, to circuit breakers having a releasable latch mechanism to provide shunt tripping operation.

2. Description of the Prior Art

Circuit breakers are widely used in industrial, commercial, and residential applications to provide protection for electrical apparatus and distribution circuits. Upon overcurrent conditions through a connected electrical circuit, the circuit breaker will automatically open to interrupt electric current flow through the circuit. Some circuit breakers utilize direct tripping operation wherein the circuit current flowing through the breaker also flows through a device such as a bimetal element or an electromagnet to directly actuate a latch mechanism. In multiple circuit breakers employing direct tripping operation, a separate trip mechanism is often employed for each pole. Overcurrent conditions through any pole of the circuit breaker will thus cause its associated trip device to function, effecting separation of the contacts of that pole. Since it is generally desirable to have all poles of the circuit breaker trip at the same time, such circuit breakers employ a trip bar or other means connecting the various poles of the circuit breaker to provide simultaneous tripping operation of all poles.

Other circuit breakers employ shunt tripping operation wherein a sensing device such as a current transformer is used to monitor the current flow through each pole of the circuit breaker and generate a tripping signal upon overcurrent conditions. Tripping signals from any pole can then in turn actuate a single latch mechanism to effect automatic separation of the contacts. A trip bar is also required on shunt tripping circuit breakers which employ multiple tripping modes, such as manual push-to-trip and undervoltage trip capabilities.

In order to provide isolation between the various poles of the circuit breaker, the trip bar must be insulated therefrom. Prior art circuit breakers have employed trip bars of molded insulating material which are rotated by the tripping action of any one pole or tripping device, thereby causing the other associated poles or tripping devices to also operate. A circuit breaker employing such a molded insulating rotating trip bar is described in U.S. Pat. No. 3,422,381 issued Jan. 14, 1969 to Julius Toth and assigned to the assignee of the present invention. Such an arrangement generally provides excellent service. However, under certain conditions problems can develop with rotating trip bars of molded insulating material, such as warping or breakage. It would therefore be desirable to provide a circuit breaker employing a metal trip bar.

Prior art circuit interrupters employing trip bars also lacked features which are advantageous for certain applications. For example, some circuit breakers in the prior art have required separate operations to reset the latch mechanism following a tripping operation. It would be desirable to provide a circuit breaker employing a self-resetting latch mechanism. It would also be desirable to provide a mechanism for releasing the latch of the circuit breaker without moving the trip bar.

In addition, for circuit breakers employing separate latch release mechanisms, trip mechanisms, and undervoltage trip mechanisms, it is desirable to provide means for automatically resetting all such mechanisms.

SUMMARY OF THE INVENTION

In accordance with a preferred embodiment of the invention, there is provided a circuit breaker comprising separable contacts, an operating mechanism for moving the contacts between open and close positions, the operating mechanism comprising a cradle releasable to effect automatic separation of the contacts, and a latch mechanism operable upon actuation to release the cradle. The latch mechanism comprises a releasable latch member cooperating with the cradle to maintain the cradle in the latched position, trip lever means for releasing the latch member, and a movable trip bar adapted for translational movement to operate the trip lever to release the cradle. The circuit interrupter further comprises trip means for causing translational movement of the trip bar to actuate the latch mechanism and release the cradle and effect automatic separation of the contacts.

DESCRIPTION OF THE PREFERRED EMBODIMENT

Figure 1:
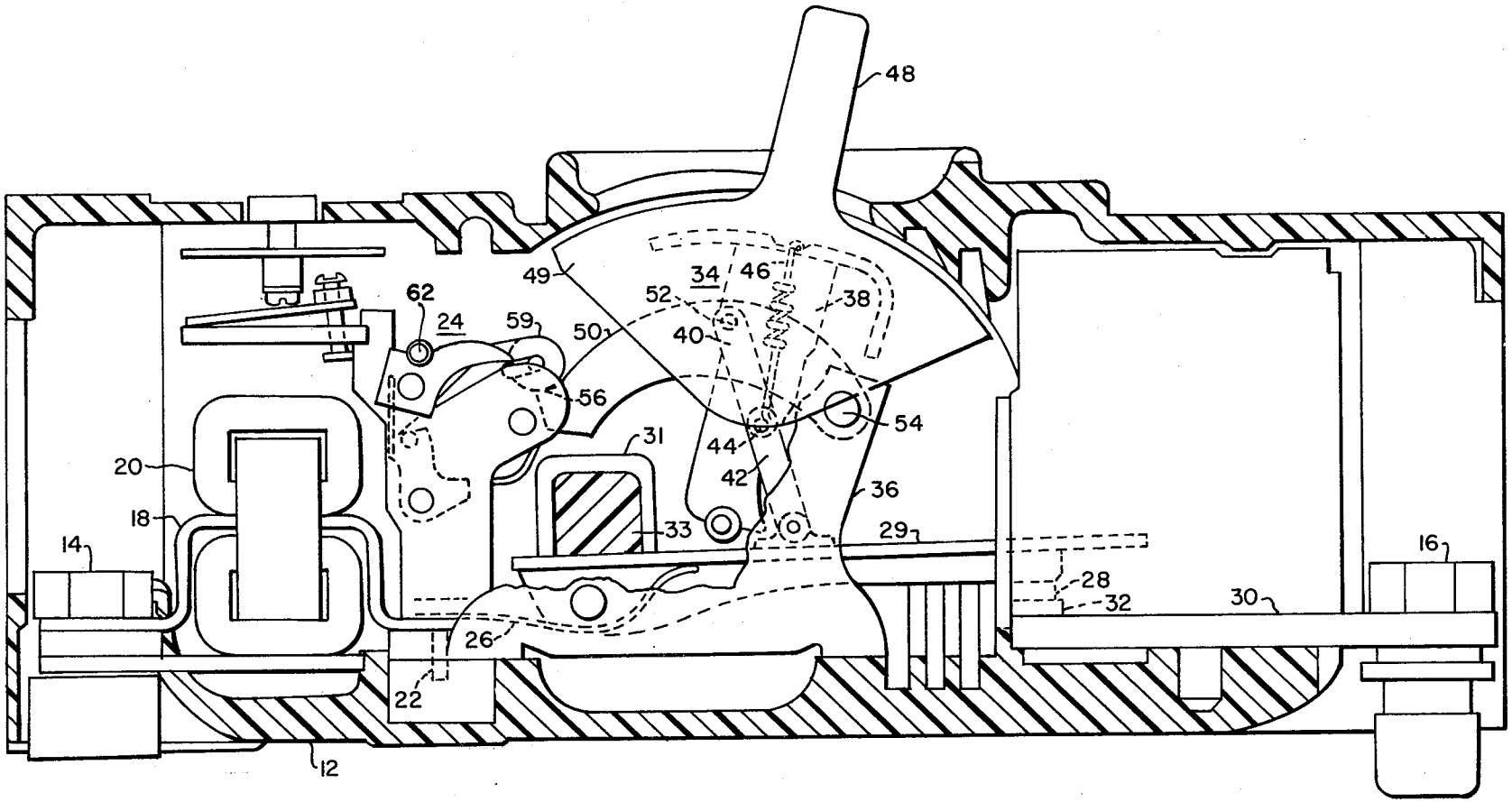
FIG. 1 is a vertical sectional view, with parts broken away, of a circuit breaker employing the principles of the present invention.

Referring now to the drawings, wherein like reference characters refer to like members, there is shown in FIG. 1 a molded case circuit breaker 10 comprising an insulating housing 12. The circuit breaker 10 is of the type more specifically described in U.S. Pat. No. 3,585,329 issued June 15, 1971 to Eugene J. Walker, James P. Ellsworth, and Alfred E. Maier. Thus, only a brief description of the circuit breaker is given herein. The housing 12 is separated into three adjacent compartments containing three pole units of the multi-pole circuit breaker in a manner well known in the art. In each pole unit, a pair of solderless terminals 14 and 16 are provided at opposite ends of the compartment to enable connection of the circuit breaker in an electric circuit.

In each of the pole unit compartments a rigid stationary conductor 18 feeds through a current transformer 20. A mounting screw 22 extends through a latch mechanism 24 and into the housing 12. The mounting screw 22 also serves to connect the rigid conductor 18 to a flexible shunt 26 which is in turn connected to a contact carrier 29 supporting a movable contact. Each pole unit of the circuit breaker 10 also includes a rigid conductor 30 connected at one end to the terminal 16 and supporting at the other end thereof a fixed contact 32 cooperating with the movable contact 28.

A single operating mechanism 34 for controlling all three circuit poles is mounted in the center pole unit of the circuit breaker. The operating mechanism 34 comprises a frame 36 including spaced supporting plate parts mounted on the base of the housing 12, a pivoted forked operating lever 38, upper and lower toggle links 40, 42 which are pivotally connected by means of a knee pin 44, a pair of tension springs 46, and a movable insulating handle 48. The upper toggle link 40 is pivotally connected to a movable releasable arm or cradle 50 by means of a pin 52. The releasable cradle 50 is pivotally supported on the frame 36 by means of a pivot pin 54. The other end of the releasable cradle 50 includes a latch surface 56 which is held in a latched position by a primary latch member, or roller, 59. The roller 59 is part of the latch mechanism 24, as shown more clearly in FIG. 2.

In operation, connection is made to an electrical circuit at the terminals 14 and 16. The current path through the circuit breaker thus flows from the terminal 14 through the stationary conductor 18, the flexible shunt 26, the contact carrier 29, the movable contact 28, the fixed contact 32, and the stationary conductor 18 to the terminal 16. Operation of the handle 48 is operable to move the contact carrier 29 and open and close the contacts 28, 32 in a well known manner. The contact carrier 29 includes a staple 31 which is secured about a molded insulating cross arm 33, connecting the contact carriers of each pole unit.

Figure 6:
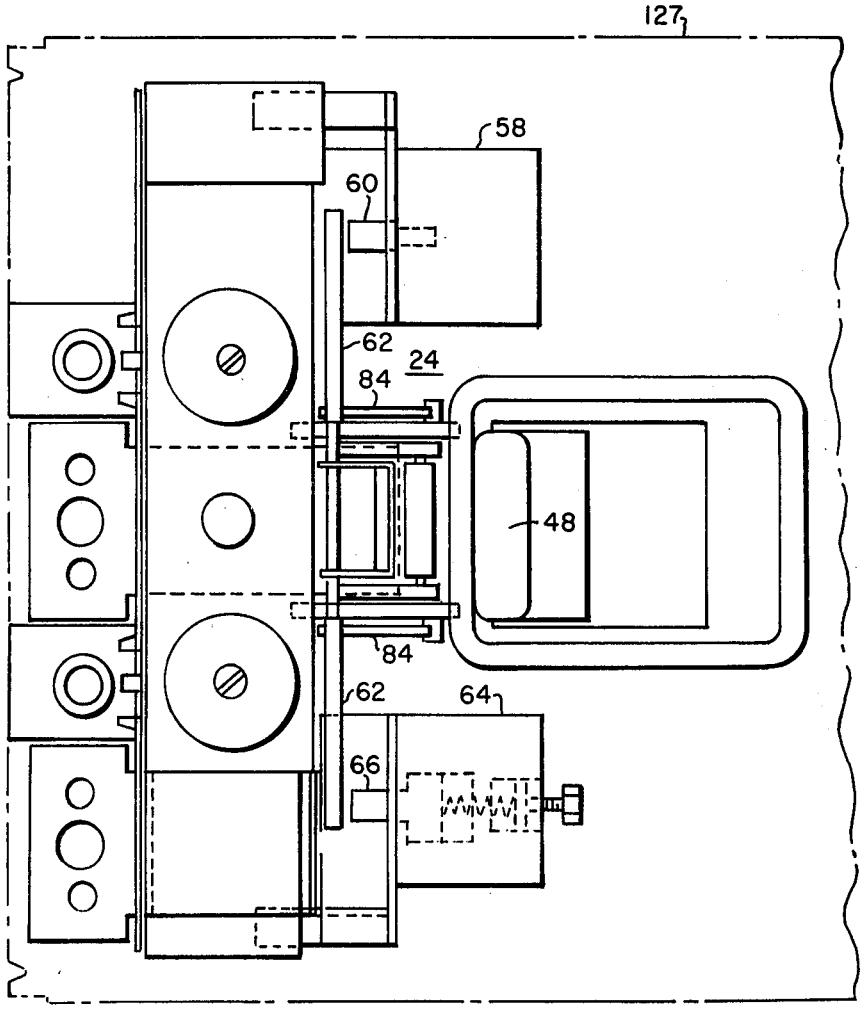
FIG. 6 is a plan view of the circuit breaker of FIG. 1, with parts broken away, showing the trip actuator and undervoltage release actuator.

The current transformer 20 is connected to solidstate electronic circuitry, not shown, which is in turn connected to a flux transfer trip mechanism 58 mounted within one of the outside pole unit compartments, as shown in FIG. 6. The flux transfer trip mechanism 58 is of the type described more completely in U.S. Pat. No. 3,783,423 issued Jan. 1, 1974 to Alfred E. Maier et al. Overcurrent conditions through any of the pole units will be detected by the corresponding current transformer 20, the output signal of which is then processed by the electronic circuitry to activate the flux transfer trip mechanism 58. This causes a plunger 60 in the mechanism 58 to move to the left as shown in FIG. 6, moving a trip bar 62 to the left and actuating the latch release mechanism 24 in a manner to be described more completely.

The circuit breaker 10 may also include an undervoltage release mechanism 64 mounted in the outside pole unit compartment opposite the flux transfer trip mechanism 58. The undervoltage mechanism 64 can be actuated in any well known manner to move a plunger 66 to the left as shown in FIG. 6, thus operating the trip bar 62 in a manner similar to that described above with regard to the flux transfer trip mechanism 58.

Figure 2:
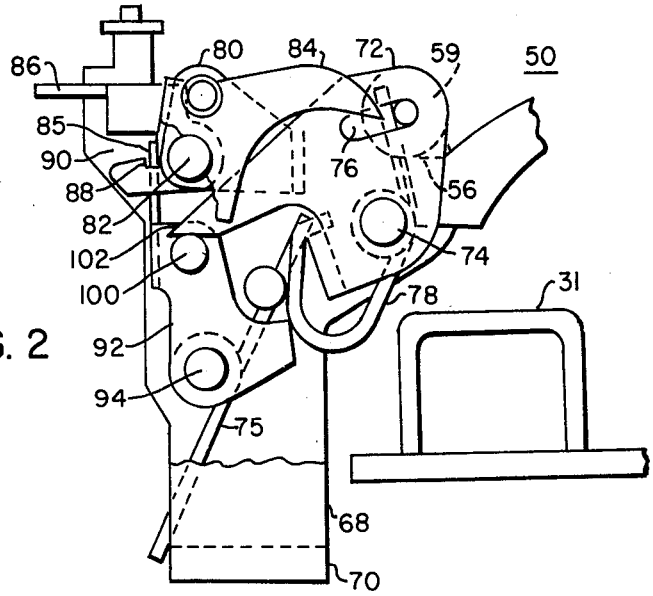
FIG. 2 is a detailed side elevational view of the latch mechanism and operating mechanism cradle of the circuit breaker shown in FIG. 1, with the latch mechanism shown in the latched position.

The latch mechanism 24, shown in more detail in FIG. 2, comprises a generally U-shaped frame member having two symmetrical side plates 68 connected by a base member 70. The base member 70 is secured to the housing 12 by means of the mounting screw 22. The roller 59 is movably mounted within slots 76 in a roller lever 72, the roller lever 72 being pivotally supported between the side plates 68 by means of a pivot pin 74. The roller 59 is biased to the right as shown in FIG. 2 by means of spring 78 surrounding the pivot pin 74. Reset springs 75 are provided to maintain the roller lever 72 in the tripped position until the cross bar staple 31 rotates counterclockwise to reset the lever 72 by pushing on the springs 78. Thus, if the contacts are welded closed, the lever 72 is not reset and the breaker cannot be latched. This assures that the handle 48 will remain in the ON position, providing a positive indication of the ON status of the contacts, despite the occurrence of a tripping operation.

Figure 5:
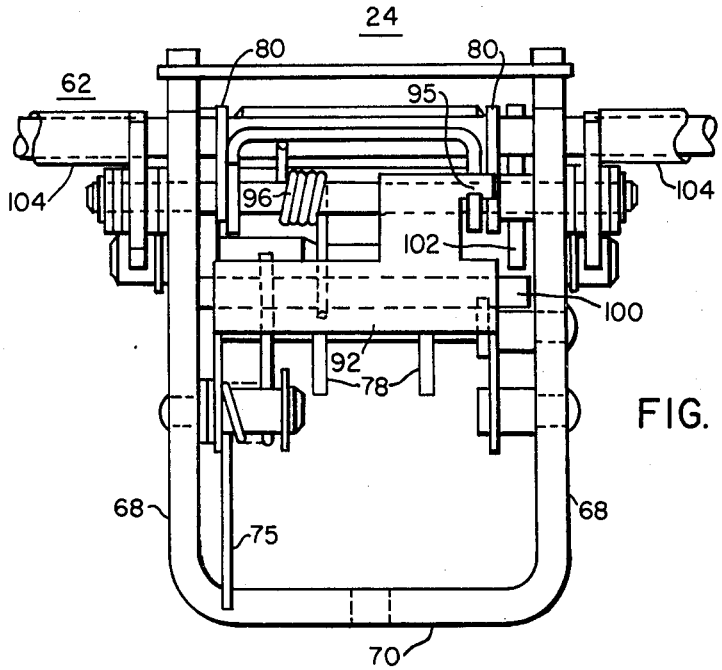
FIG. 5 is a front elevational view of the latch mechanism.

The trip bar 62 is supported by a generally U-shaped bar lever 80 which is in turn pivotally supported between the side plates 68 by means of a pivot rod 82. Reset ears 84 are also pivotally supported upon the rod 82 to the outside of the side plates 68 and are connected to the trip bar 62. Also pivotally supported upon the pivot rod 82 and independent of the bar lever 80 is a trip lever 86 including an extending arm having a catch surface 88 to form a notched slot 90. A secondary latch member, or pin lever, 92 is pivotally supported between the side plates 68 at the point 94 and includes an upward extending L-shaped arm 95 (FIG. 5) which cooperates with the notched slot 90 of the trip lever 86. A spring 96 biases the trip lever 86 and pin lever 92 in a clockwise direction. The pin lever 92 includes a restraining pin 100 which cooperates with an extending ear 102 of the roller lever 72 to maintain the roller lever 72 in the position shown in FIG. 2.

As can be seen in FIG. 2, the latch surface 56 of the cradle 50 rests upon the lower surface of the roller 59 and is thereby restrained from rotating in a clockwise direction. Thus, the circuit breaker 10 is in an untripped condition, and the handle 48 is operable to move the contacts 28, 32 between open and closed positions.

The trip bar 62 comprises a rod of steel, aluminum, or other metal which is covered by insulating tubes 104 of phenolic or other suitable insulating material. The insulating tubes 104 serve to electrically isolate the three poles of the circuit breaker 10. When the trip bar 62 is translated to the left by either the flux transfer trip mechanism 58 or the undervoltage mechanism 64, as described above, the bar lever 80 rotates in a counterclockwise direction about the pivot rod 82. The trip bar 62 contacts the trip lever 86 at the point 98, causing the trip lever 86 to rotate in a counterclockwise direction against the action of the bias spring 96 about the pivot rod 82. A small amount of rotation of the trip lever 86 causes the surface 88 of the notched slot 90 to disengage itself from the L-shaped extending arm 95 of the pin lever 92. The upward force exerted upon the roller 59 causes the roller lever 72 to exert a downward counterclockwise rotating force upon the pin lever 92 through the action of the ear 102 upon the restraining pin 100. When the surface 88 is sufficiently rotated to allow the upstanding L-shaped arm 95 to become free of the slotted notch 90 the pin lever 92 will rotate under the influence of the transmitted cradle force to the dashed line position of FIG. 3, moving the pin 100 out of the path of movement of the ear 102, thereby allowing the roller lever 72 to rotate in a counterclockwise direction to the dashed line position of FIG. 3, moving the roller 59 to the left and allowing the cradle 50 to rotate in a clockwise direction. Freeing of the cradle 50 allows the toggle links 40, 42, to collapse in a well known manner.

Figure 3:
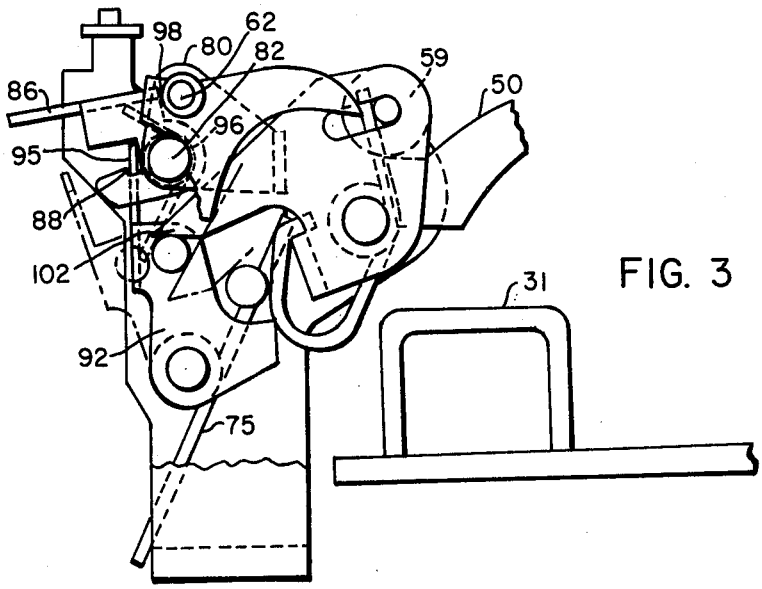
FIG. 3 is a view similar to FIG. 2 with the latch mechanism and cradle shown at the instant of cradle release.
Figure 4:
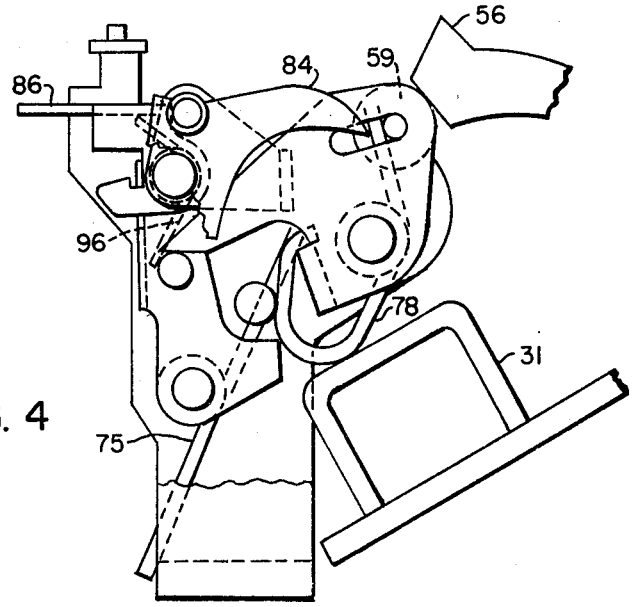
FIG. 4 is a view similar to FIG. 3, with a latch mechanism shown in the position following a tripping operation.

As soon as the ear 102 of the roller lever 72 has rotated out of the influence of the pin 100, the bias spring 96 causes the pin lever 92 to quickly rotate in a clockwise direction, allowing the L-shaped arm 95 to return to the notched slot 90. At this point, the trip lever 86 is still in a counterclockwise rotated position as shown in FIG. 3. As the contact carrier 29 rapidly rotates in a counterclockwise direction, the staple 31 comes in contact with the reset springs 78. This causes the roller lever 72 to rotate in a clockwise direction about the pin 74 and return to its original position. In doing so, the ear 102 contacts the lower side of the pin 100 and, since the trip lever 86 is still depressed at this time, the pin lever 92 is free to momentarily rotate in a counterclockwise direction and allow the ear 102 to pass. The roller lever 72 then moves from the dashed line position of FIG. 3 to assume its original position. When the trip lever 86 is allowed to rotate in a clockwise direction (due to the action of the spring 96) the surface 88 once again captures the L-shaped arm 95 of the pin lever 92. At this time the latch mechanism 24 is completely reset and is in the position shown in FIG. 4.

In order to reset the operating mechanism 34, the handle 48 is operated in a counterclockwise direction to the left as shown in FIG. 1 to rotate the cradle 50 in a counterclockwise direction and reset the operating mechanism 34 in a well known manner. The roller 59 operates in the slots 76 to allow the cradle 50 to slip under the roller 59 when the operating mechanism 34 is reset. Since the trip lever 86 is independently pivoted upon the pin 82, it is possible for the latch mechanism 24 to be released without the trip bar 62 moving. This is an advantage since it allows the undervoltage mechanism and shunt trip mechanism to be reset by the handle 48 operating the trip bar 62 through the ears 84, while at the same time allowing a rating plug interlock to function through the trip lever 86, releasing the cradle. Thus the latch mechanism 24 can be released before the handle has moved a distance sufficient to charge the springs 46. This prevents the large shock to which the mechanism 34 would be subjected should the springs 46 become highly charged before the cradle 50 were released.

A shoulder 49 of the handle contacts the ears 84 attached to the pin 82, causing the ears 84 and the trip lever 62 to which they are attached to rotate in a clockwise direction about the pin 82. As the trip bar 62 moves to the right as shown in FIG. 1, the flux transfer trip mechanism 58 and the undervoltage release mechanism 64 are both reset.

In summary, it can be seen that the present invention provides a circuit breaker having an improved latch mechanism and trip bar. Problems of warping and breaking which occasionally occurred with molded rotating trip bars are eliminated with the use of the metallic trip bar in the present invention. Providing a trip bar which translates rather than rotates allows the elimination of trip bar levers at each independent pole. Furthermore, the trip bar of the present invention can be used to reset the undervoltage mechanism and the flux transfer trip mechanism. The metal trip bar of standard rod stock and the simple stamped sheet metal bar lever is lower in cost than the prior art molded insulating trip bars. It can be seen therefore that the present invention provides improved performance with a reduction in cost.

We claim:

1. A circuit interrupter comprising:

a center pole unit and a pair of outside pole units, each of said pole units comprising separable contacts and means for supporting said contacts;

an operating mechanism for moving said contact support means to operate said contacts between open and closed positions, said operating mechanism comprising an arm releasable to effect automatic separation of said contacts;

a latch mechanism operable upon actuation to release said arm, said latch mechanism comprising:

a releasable primary latch member cooperating with said arm to maintain said arm in the latched position, a movable secondary latch member restraining said primary latch member, means for biasing said secondary latch member toward a position restraining said primary latch member, a movable trip lever maintaining said secondary latch member in a position restraining said primary latch member, and a movable trip bar adapted for translational movement and operable when translated to move said trip lever to release said secondary latch member, said primary latch member, and said arm to effect automatic separation of said contacts;

an undervoltage release mechanism operable upon actuation to translate said trip bar; and an overcurrent trip mechanism operable upon actuation to translate said trip bar.

2. A circuit interrupter, comprising:

a center pole unit and two outside pole units, each of said pole units comprising separable contacts;

a molded insulating housing enclosing all of said pole units;

an operating mechanism for moving said contacts between open and closed positions, said operating mechanism comprising a cradle releasable to effect automatic separation as of said contacts;

a latch mechanism mounted upon said center pole unit and operable upon actuation to release said cradle, said latch mechanism comprising:

a releasable latch member cooperating with said cradle to maintain said cradle in the latched position;

trip lever means for releasing said latch member; and a movable trip bar adapted to revolve about an axis to operate said trip lever to release said cradle;

overcurrent trip means mounted upon one of said outside pole units for causing revolving movement of said trip bar upon overcurrent conditions through said interrupter to actuate said latch mechanism and release said cradle to effect automatic separation of said contacts; and undervoltage trip means mounted upon the other of said outside pole units for causing revolving movement of said trip bar upon undervoltage conditions to said undervoltage trip means to actuate said latch mechanism and release said cradle to effect automatic separation of said contacts.

3. A circuit interrupter as recited in claim 2 wherein said trip bar is disposed in relation to said operating mechanism, said undervoltage trip means, and said overcurrent trip means so that a resetting operation of said operating mechanism is operable to move said trip bar, said trip bar movement effecting reset of said undervoltage trip means and said overcurrent trip means.

4. A circuit interrupter as recited in claim 3 wherein said trip bar comprises a metal rod and insulating material covering said rod.

5. A current interrupter as recited in claim 2 wherein said trip bar comprises a metal rod and insulating material covering said rod.

6. A circuit interrupter as recited in claim 2 wherein said overcurrent trip means comprises electromechanical transducer means operable upon actuation to cause revolving movement of said trip bar, and sensing means responsive to current flow through said circuit interrupter for actuating said transducer means upon overcurrent conditions through said circuit interrupter.

7. A multi-pole circuit interrupter, comprising:

a plurality of pole units each comprising separable contacts;

a single operating mechanism for moving all of said contacts between open and closed positions, said operating mechanism comprising a cradle releasable to effect automatic separation of said contacts;

a single latch mechanism operable upon actuation to release said cradle, said latch mechanism comprising:

a releasable latch member cooperating with said cradle to maintain said cradle in the latched position;

trip lever means for releasing said latch member; and a movable trip bar adapted for translational movement to operate said trip lever to release said cradle; and trip means for causing translational movement of said trip bar to actuate said latch mechanism and release said cradle to effect automatic separation of said contacts.

8. A circuit interrupter as recited in claim 7 wherein said trip bar revolves about an axis.

9. A circuit interrupter as recited in claim 8 wherein said trip bar comprises a metal rod and insulating material covering said metal rod.

10. A circuit interrupter as recited in claim 9 wherein said circuit interrupter comprises a center pole unit, two outside pole units, and a molded insulating housing enclosing said pole units, and wherein said latch mechanism is mounted upon said center pole unit.

11. A circuit interrupter as recited in claim 10 comprising an undervoltage release mechanism mounted upon one of said outside pole units and wherein said trip means is mounted upon the other of said outside pole units, said undervoltage release mechanism and said trip means being disposed in relation to said trip bar so as to cause translational movement of said trip bar when either said undervoltage release mechanism or said trip means is actuated.

12. A circuit interrupter as recited in claim 11 wherein said trip bar is disposed in relation to said operating mechanism, said undervoltage release mechanism, and said trip means so that a resetting operation of said operating mechanism is operable to move said trip bar, said trip bar movement effecting reset of said undervoltage release mechanism and said trip means.

13. A circuit interrupter as recited in claim 8 wherein said circuit interrupter comprises a center pole unit, two outside pole units, and a molded insulating housing enclosing said pole units, and wherein said latch mechanism is mounted upon said center pole units.

14. A circuit interrupter as recited in claim 13 comprising an undervoltage release mechanism mounted upon one of said outside pole units and wherein said trip means is mounted upon the other of said outside pole units, said undervoltage release mechanism and said trip means being disposed in relation to said trip bar so as to cause translational movement of said trip bar when either said undervoltage release mechanism and said trip means is actuated.

15. A circuit interrupter as recited in claim 14 wherein said trip bar is disposed in relation to said operating mechanism, said under voltage release mechanism, and said trip means so that a resetting operation of said operating mechanism is operable to move said trip bar, said trip bar movement effecting reset of said undervoltage release mechanism and said trip means.

16. A circuit interrupter as recited in claim 8 wherein said latch member is supported for pivotal movement about a point spaced from the axis or revolution of said trip bar.

17. A circuit interrupter as recited in claim 7 comprising means supporting at least one of said separable contacts and being operable between open and closed positions, said contact support means being disposed in proximity to said latch mechanism so that following a latch release operation said latch mechanism is reset by said contact support means when said contact support means moves from closed to the open position.

18. A circuit interrupter as recited in claim 8 wherein said latch mechanism comprises a pivoting bar lever supporting said trip bar, and said trip lever means comprises a trip lever member mounted for pivotal movement independent of said bar lever and adapted to be actuated by said bar lever upon revolving movement of said trip bar to cause release of said latch member.

19. A circuit interrupter as recited in claim 8 wherein said latch mechanism comprises a bar lever supporting said trip bar and mounted for pivoting movement about the axis of revolution of said trip bar, and said trip lever means comprises a trip lever member mounted for pivotal movement independent of said bar lever, said trip lever member adapted to be actuated by said bar lever upon revolving movement of said trip bar to cause release of said latch member.

20. A circuit interrupter as recited in claim 19 wherein said bar lever and said trip lever member are independently pivoted about the same point.

21. A multipole circuit interrupter, comprising:

a plurality of pole units each comprising separable contacts;

a single operating mechanism adapted for manual operation to move all of said contacts between open and closed positions, said operating mechanism releasable from a latched to a tripped position to effect automatic separation of said contacts;

a single latch mechanism operable upon actuation to release said operable mechanism, said latch mechanism comprising:

a releasable latch member cooperating with said operating mechanism to maintain said operating medium in a latched position;

trip lever means operable upon actuation to release said latch member; and movable trip bar means independently mounted with respect to said trip lever means for actuating said trip lever means;

a plurality of electromechanical trip actuator means for initiating separation of said contacts by moving said trip bar means in response to conditions calling for separation of said contacts; and means linking said operating mechanism to said trip bar means;

said trip bar means being so disposed in relation to said electromechanical trip actuator means that manual operation of said operating mechanism is operable to move said trip bar means through said linkage means to reset said electromechanical trip actuator.

* * * * *